US006796074B1

(12) United States Patent
Obong

(10) Patent No.: US 6,796,074 B1
(45) Date of Patent: Sep. 28, 2004

(54) FIREARM MAGAZINE GRIP

(76) Inventor: Robert V. Obong, P.O. Box 70096, Pasadena, CA (US) 91117-7096

( * ) Notice: Subject to any disclaimer, the term of this patent is extended or adjusted under 35 U.S.C. 154(b) by 0 days.

(21) Appl. No.: 10/177,616

(22) Filed: Jun. 19, 2002

(51) Int. Cl.[7] ..... F41A 15/00
(52) U.S. Cl. ..... 42/90; 42/87; 224/931
(58) Field of Search ..... 42/124, 90, 87; 224/931

(56) References Cited

U.S. PATENT DOCUMENTS

| | | | | | |
|---|---|---|---|---|---|
| 3,769,733 | A | * | 11/1973 | Nelson | 42/89 |
| 3,880,389 | A | * | 4/1975 | Burris | 248/205.1 |
| 4,299,044 | A | * | 11/1981 | Johannsen | 42/127 |
| 5,174,482 | A | * | 12/1992 | Rogers et al. | 224/239 |
| 5,676,241 | A | * | 10/1997 | Degoix et al. | 206/3 |
| 6,050,464 | A | * | 4/2000 | Ramsey et al. | 224/196 |
| 6,202,908 | B1 | * | 3/2001 | Groover | 224/239 |
| 6,250,198 | B1 | * | 6/2001 | Vendetti et al. | 89/44.02 |
| 6,289,782 | B1 | * | 9/2001 | Watson, Jr. | 89/37.01 |
| 6,327,805 | B1 | * | 12/2001 | Clifton, Jr. | 42/90 |
| 6,435,976 | B1 | * | 8/2002 | Galliers | 473/244 |
| 6,499,245 | B1 | * | 12/2002 | Swan | 42/71.01 |

OTHER PUBLICATIONS

Buffer technologies (web archived Feb. 6, 2001) http://web.archive.org/web/20010206151055/www.buffertech-.com/magcinch.htm□□.*

*Defense Procurement Manufacturing Services, Inc.* (DPMS), Website page from website with homepage at http://www.shootstore.com, with illustration of "Side–By–Side A–15 Magazine Holder", Dec. 5, 2002, Product 7 of 21.

* cited by examiner

*Primary Examiner*—Jack Keith
*Assistant Examiner*—M. Thomson
(74) *Attorney, Agent, or Firm*—Cohen Sakaguchi & English LLP

(57) ABSTRACT

A device for holding a plurality of firearm magazines is disclosed. The device includes an upper plate, a lower plate, and a securing member. The upper plate is rotationally positioned about the securing member, and the lower plate is rotationally mounted to the securing member below the upper plate. Magazines are placed between the upper plate and the lower plate, which together securely engage the magazines when tightened with the securing member. Multidirectional movements of the upper plate and the lower plate facilitate placement and securing of the magazines. The upper plate has a recess allowing a head of the securing member to rest substantially therein and/or flush with the outer surface of the upper plate. Substantially curved edge surfaces of the plates provide a smooth transition from one surface to another.

23 Claims, 6 Drawing Sheets

FIREARM MAGAZINE GRIP

FIELD OF INVENTION

The present invention relates generally to a firearm magazine or clip. More particularly the present invention relates to a device for holding or joining a plurality of firearm magazines or clips that enable accessibility to a plurality of ammunition.

INCORPORATION BY REFERENCE

The contents of each U.S. patent or other reference, if any, cited in this application, are hereby incorporated by reference.

BACKGROUND OF INVENTION

Many modem firearms used for combat or sporting activities are capable of high cyclic rates of fire and are usually equipped with magazines capable of holding a plurality of cartridges. Such magazines must usually be manually released from the weapon when they have become empty, at which time a second magazine must be inserted into the weapon before firing may be continued. Typically, the second or third magazine is carried in a protective pouch attached to the weapon user's belt or carried in the user's vest or pocket. Since removal and insertion of the additionally loaded magazine may take an undesirably long time, various devices have been developed in an effort to expedite and ease the loading of the additional magazine.

Generally, multiple magazine holders serve the purpose of coupling together two or more magazines so that the combatant or sportsman will have immediately available multiple magazines rather than one magazine for use with the weapon. Such holders have previously welded or taped magazines together in an effort to provide an ability to fire more rounds quickly. Alternatively, a clip joining device for holding two clips end to end (see, e.g., U.S. Pat. No. 4,685,238, issued Aug. 11, 1987 to Schoepflin), or a box-like protective device attachable to the weapon (see, e.g., U.S. Pat. No. 4,484,404, issued Nov. 24, 1984 to Johnson), are known. Another magazine holder, distributed by Defense Procurement Manufacturing Services, Inc. (DPMS) and advertised on May 22, 2002 at the DPMS website http://www.dpmsinc.com, discloses a "Triple Mag Holder". Although generally well-suited for holding multiple magazines, the DPMS device presents potential problems for the user regarding safety and ease of placing and securing multiple magazines.

Accordingly, there is a need for a device capable of holding a plurality of firearm magazines that is more efficient, safer, highly effective, and more reliable than known devices.

SUMMARY

The present invention describes a device capable of holding a plurality of firearm magazines that is more efficient, safer, highly effective, and more reliable than known devices. The device comprises an upper plate, a lower plate, and an interconnected securing member. The upper plate is rotationally positioned about the securing member, and the lower plate is rotationally mounted to the securing member below the upper plate. Magazines are placed between the upper plate and the lower plate in slots defined by the inner surfaces of the plates, and together the plates securely engage the magazines in a clamp-like manner when tightened with the securing member.

Multidirectional movements of the plates allow them to be adjusted in order to facilitate placement and securing of the magazines. Adjustment of the upper plate includes free/unrestricted rotational movement about the central longitudinal axis of the securing member, and restricted vertical translational movement about the central longitudinal axis of the securing member. Adjustment of the lower plate includes rotational movement about the central longitudinal axis of the securing member. The upper plate has an inner lip within a recess, allowing the securing member head to be contained substantially within the recess and/or rest substantially flush with the outer surface of the upper plate when in use. Additionally, the upper plate and the lower plate have substantially curved edge surfaces, providing a smooth transition from one surface to another.

Thus, one embodiment of the present invention includes a device for holding two magazines for use with a firearm comprising: an upper plate having an outer surface and an inner surface; a lower plate having an outer surface and an inner surface; and a securing member having a head, a body, and a foot, said head having a top surface and a bottom surface; wherein the upper plate is rotationally positioned about the body of the securing member; the lower plate is rotationally mounted to the foot of the securing member; the upper plate has a recess with an aperture, and the securing member foot and the securing member body pass through the recess and aperture of the upper plate, the securing member head being received in the recess such that the bottom surface of the securing member head engages an inner lip of the recess thus preventing the securing member head from passing through the aperture of the upper plate, the depth of the recess and the height of the securing member head being such that the top surface of the securing member head is contained substantially within the recess; the lower plate receives the securing member foot in a threaded aperture; and the inner surface of the upper plate defines first and second slots adapted to engage top surfaces of first and second firearm magazines respectively, and the inner surface of the lower plate defines corresponding first and second slots adapted to engage bottom surfaces of the first and the second firearm magazines respectively, such that together the upper plate and the lower plate securely receive the first and the second firearm magazines in the first and second slots respectively, upon tightening of the device.

The device may be used by: separating the upper plate from the lower plate a sufficient distance to allow a plurality of firearm magazines to be positioned therebetween; adjusting the upper plate and the lower plate to facilitate placement of the plurality of magazines therebetween, including rotating the lower plate at least five degrees about a central longitudinal axis of the securing member, rotating the upper plate at least five degrees about the central longitudinal axis, and vertically translating the upper plate about the central longitudinal axis; placing a plurality of magazines between the upper plate and the lower plate; and tightening the securing member to secure the plurality of magazines between the upper plate and the lower plate, and to position the securing member head to be substantially contained within the recess of the upper plate.

The multidirectional movement of the upper plate and lower plate, substantially curved edge surfaces and/or chamfered outer edge surfaces, recessed securing member head, and other structural elements provide for a device capable of holding a plurality of firearm magazines that is more efficient, safer, highly effective, and more reliable than known devices.

DETAILED DESCRIPTION

The present invention describes a device for holding a plurality of firearm magazines that is more efficient, safer, highly effective, and more reliable than known devices. The device comprises an upper plate, a lower plate, and a securing member. The upper plate is rotationally positioned about the securing member, and the lower plate is rotationally mounted to the securing member below the upper plate. Magazines are placed between the upper plate and the lower plate, which together securely engage the magazines when tightened with the securing member. Multidirectional movements of the plates allow them to be adjusted in order to facilitate placement and securing of the magazines. Adjustment of the upper plate includes free/unrestricted rotational movement about the central longitudinal axis of the securing member, and restricted vertical translational movement about the central longitudinal axis of the securing member. Adjustment of the lower plate includes rotational movement about the central longitudinal axis of the securing member. A recessed inner lip of the upper plate (allowing the head of the securing member to rest within and/or substantially flush with the outer surface of the upper plate) and substantially curved edges, reduce the potential for personal injury due to sharp and/or protruding surfaces.

Figure 2A:
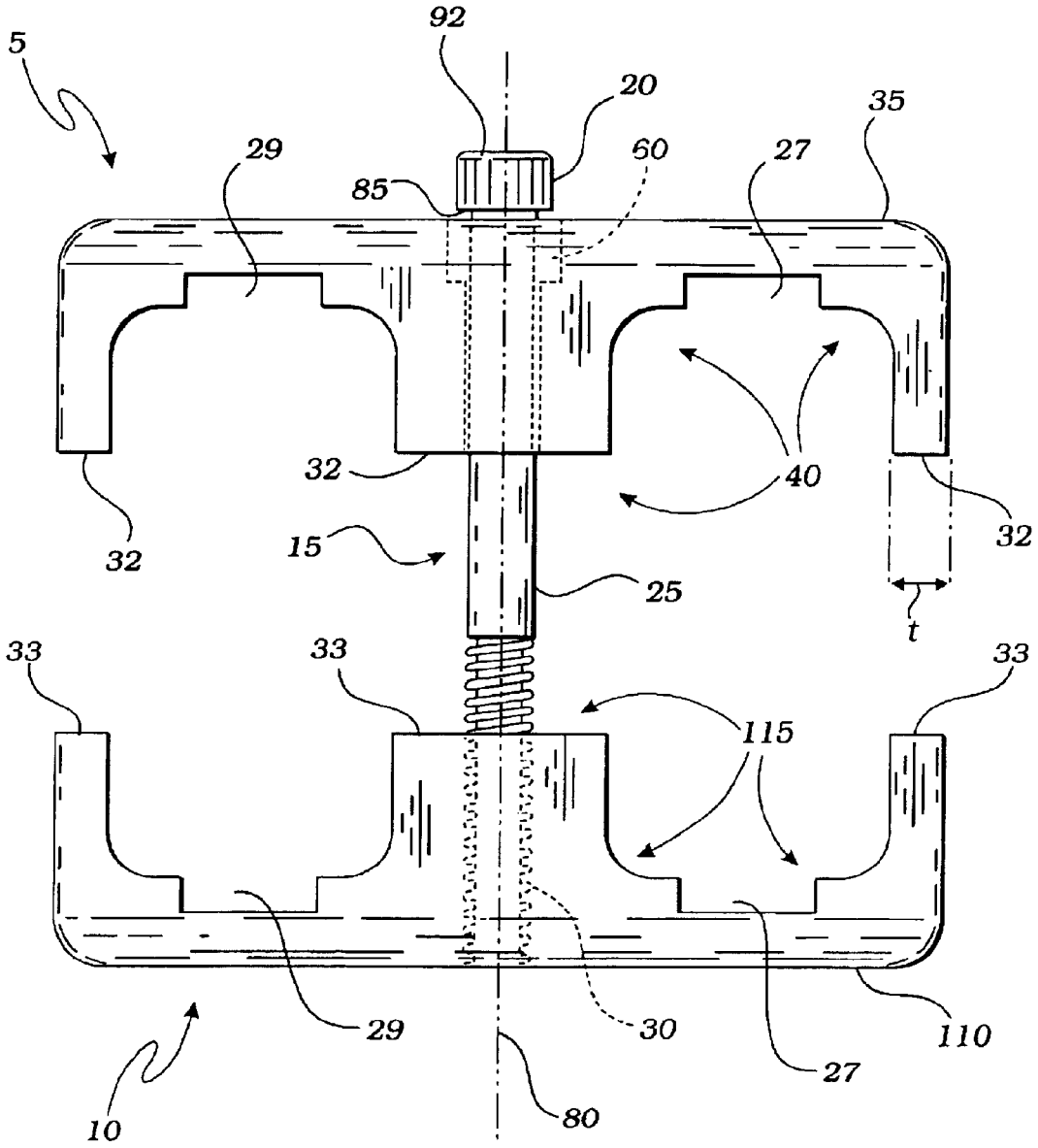
FIG. 2*a* is an elevational view of one embodiment of the firearm magazine grip in accordance with the present invention, showing a lower plate with an aperture extending entirely therethrough.
Figure 2B:
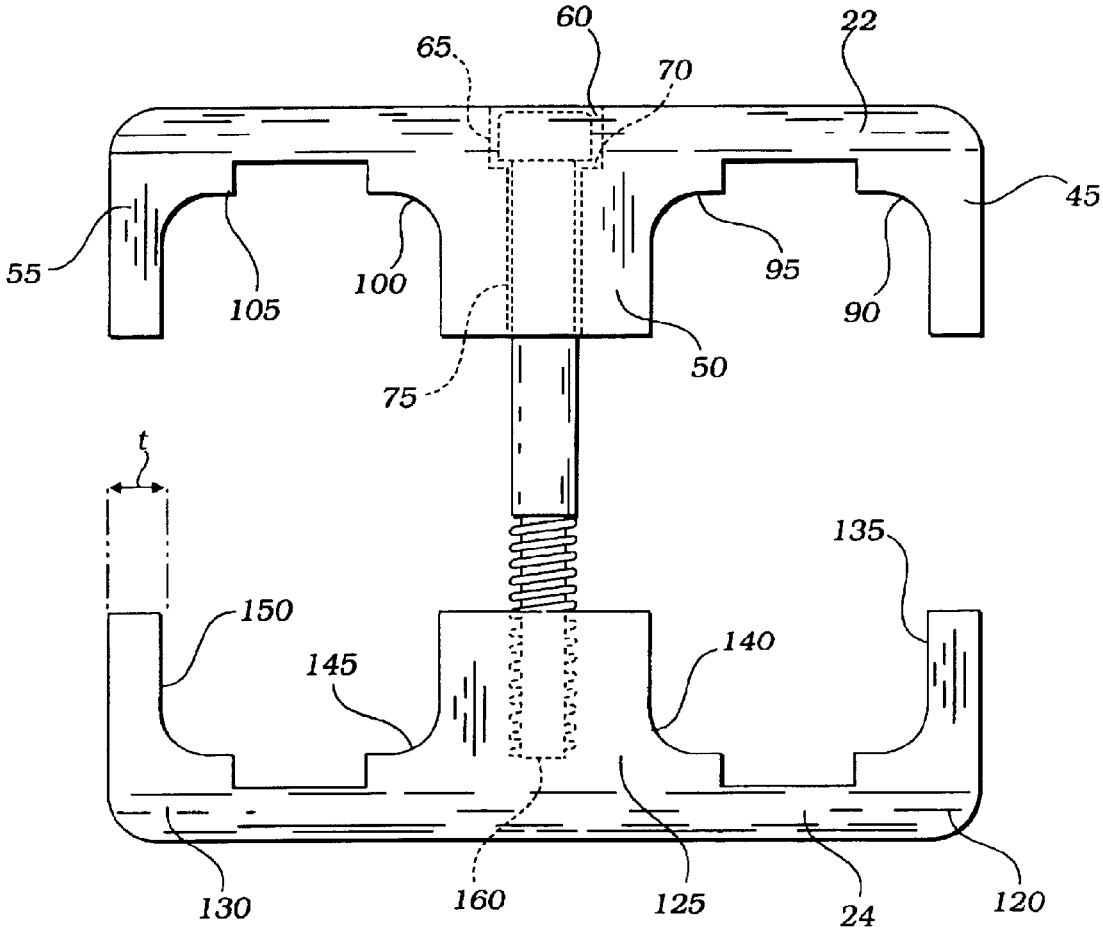
FIG. 2*b* is an elevational view of one embodiment of the firearm magazine grip in accordance with the present invention, showing a lower plate with an aperture extending only partially therethrough.

Referring now to FIGS. 2*a*–2*b,* elevational views of a preferred embodiment of the firearm magazine grip in accordance with the present invention are shown. FIG. 2*a* shows an embodiment of the present invention having a lower plate 10 with an aperture 160 that extends entirely therethrough, while FIG. 2*b* shows an embodiment having a lower plate 10 with an aperture 160 that extends only partially therethrough. Each of FIGS. 2*a*–2*b* show a device having an upper plate 5, a lower plate 10, and a securing member 15. The securing member (shown in more detail in FIG. 6) comprises a head 20, body 25, and foot 30. The head 20, body 25, and foot 30, are not necessarily distinct portions of the securing member 15, but rather these terms are used for reference to define approximate portions of the securing member 15 relative to each other. That is, the head 20 is at the top, the foot 30 is at the bottom, and the body 25 is therebetween. Together, the head 20, body 25, and foot 30 form a continuous securing member 15. There is no exact point at which the head 20 ends and the body 25 begins, or the body 25 ends and the foot 30 begins, although the head 20 and the foot 30 each preferably have physical characteristics to distinguish them from the body 25, as described herein.

Figure 3A:
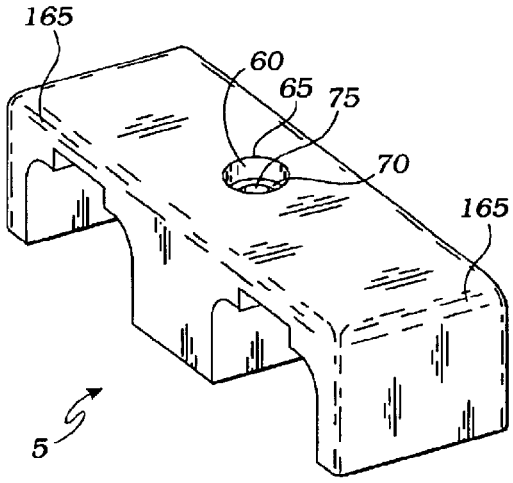
FIG. 3*a* is a perspective view of the top of an upper plate of a firearm magazine grip in accordance with the present invention, having substantially curved outer edge surfaces.
Figure 3B:
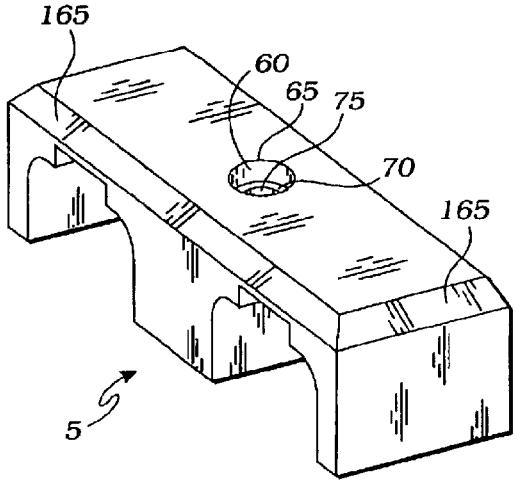
FIG. 3*b* is a perspective view of the top of an upper plate of a firearm magazine grip in accordance with the present invention, having chamfered outer surface edges.

The upper plate 5 includes an outer surface 35 and an inner surface 40. The upper plate further includes a right extension 45, center extension 50, and left extension 55. Additionally, the upper plate includes a recess/countersink 60, as best seen in FIGS. 3*a*–3*b*. The recess 60 has an outer circumference 65, an inner lip 70, and an aperture /counterbore 75. The recess 60 is of a sufficient size and shape to accommodate the securing member 15. The inner lip 70 of the recess 60 extends radially inward to define the aperture 75 in the upper plate.

Figure 6:
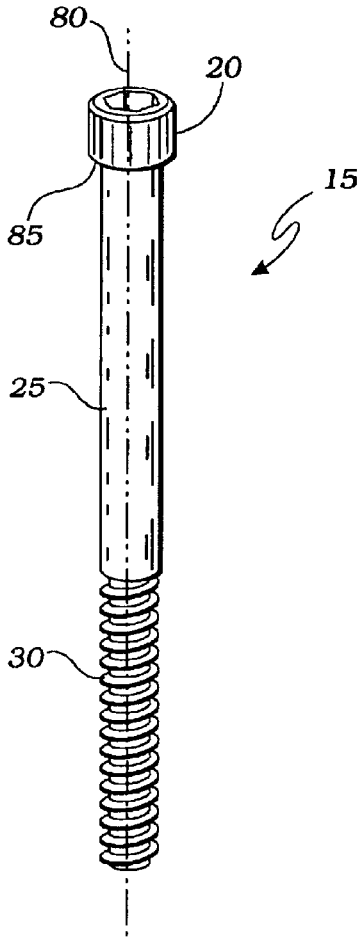
FIG. 6 is a perspective view of a preferred embodiment of the securing member of the present invention.

The typical securing member 15 is a threaded bolt or screw (see, e.g., FIG. 6) wherein the foot 30 of the securing member 15 is threaded, and the aperture 160 of the lower plate 10 is correspondingly threaded to receive the foot 30 of the securing member 15. Examples of a securing member include a pan head screw or lag bolt. The securing member head 20 may incorporate various tightening means including recesses for hex, slotted, or Phillips hardware. Additionally, the securing member head 20 may include a gripping means such as serrations, ribs, or a roughened surface to facilitate tightening of the securing member 15. The foot 30 of the securing member 15 may be threaded, expandable, or of the locking helicoil type. One such securing member 15, a threaded hex head bolt, is shown in FIG. 6. A central longitudinal axis 80 of the securing member 15 is defined for reference.

The outer circumference 65, inner lip 70, and aperture 75 generally form concentric circles, as shown in FIGS. 3*a*–3*b*. The aperture 75 is surrounded and defined by the inner lip 70, and extends entirely through the upper plate 5 from the outer surface 35 thereof to the inner surface 40 thereof. Generally, with placement of the securing member 15 into the upper plate aperture 75, the central longitudinal axis 80 thereof is positioned to pass vertically through the aperture 75. The inner lip 70 provides an area for engaging the securing member head 20. Typically, the depth of the recess 60 from the outer surface 35 of upper plate 5 to the inner lip 70, is sufficient to allow the bottom surface 85 of the securing member head 20 to rest on the inner lip 70, while the top surface 92 of securing member head 20 is substantially flush with the outer surface 35 of the upper plate 5, as shown in FIG. 2*b*. The head 20 may also be substantially contained within recess 70, such that the top surface 92 of the securing member head 20 is at or below the outer surface 35 of upper plate 5. The recess aperture 75 allows the securing member foot 30 and the securing member body 25 to pass unobstructed therethrough, but prohibits the securing member head 20 from passing therethrough.

Figure 7:
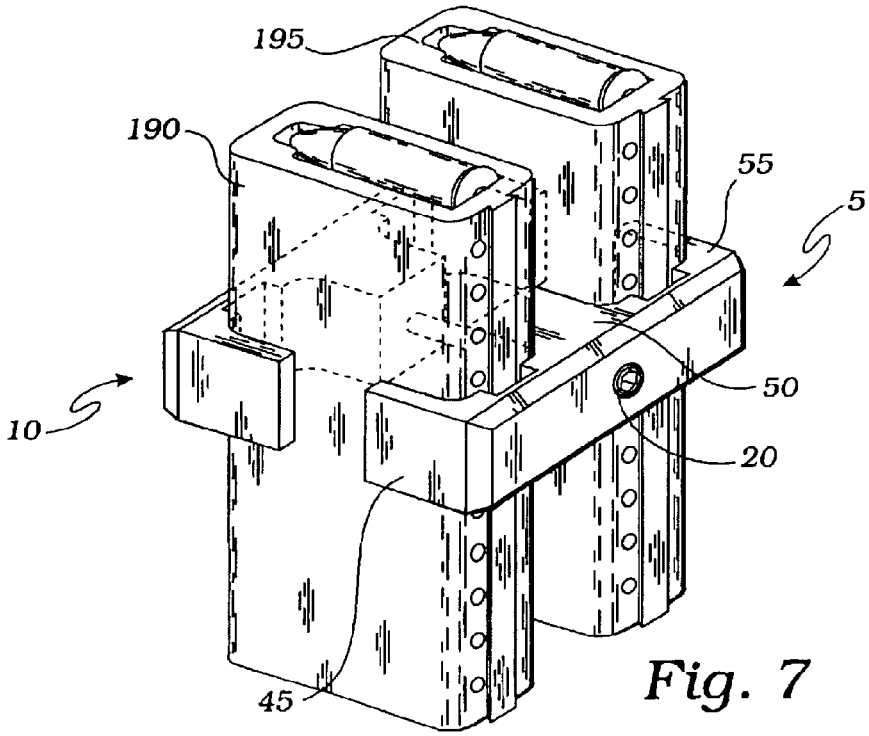
FIG. 7 is a perspective view of the firearm magazine grip of FIG. 4, holding two magazines.

As shown in FIGS. 2*a* and 2*b,* the inner surface 40 of the upper plate 5 includes inner surfaces 90 and 105 of the right extension 45 and left extension 55 respectively, and the first inner surface 95 and the second inner surface 100 of the center extension 50. Collectively, as shown in FIG. 7, the upper plate inner surfaces 90, 95, 100, 105 define first and second slots 27 and 29 respectively for receiving first and second firearm magazines respectively, and for engaging portions of the firearm magazine(s)' side or casing. Specifically, the first inner surface 95 of the center extension 50 and the inner surface 90 of the right extension 45 form a surface for engaging a first magazine within a first slot 27. Another surface for engaging a second magazine is formed by the second inner surface 100 of the center extension 50 together with the inner surface 105 of the left extension 55 within second slot 29.

Similar to the upper plate 5, as shown in FIGS. 2*a*–2*b*, the lower plate 10 includes an outer surface 110 and an inner surface 115. The lower plate further includes a right extension 120, center extension 125, and left extension 130 corresponding to the similar aspects of the upper plate 5. The inner surface 115 of the lower plate 10 forms inner surfaces 135 and 150 of the right extension 120 and left extension 130 respectively, and the first inner surface 140 and the second inner surface 145 of the center extension 125. Collectively, as shown in FIG. 7, the bottom plate inner surfaces 135, 140, 145, 150 define first and second slots 27 and 29 respectively for receiving first and second firearm magazines respectively, and for engaging portions of the firearm magazine(s)' side or casing. Specifically, the first inner surface 140 of the center extension 125 and the inner surface 135 of the right extension 120 form a surface for engaging a first magazine within first slot 27. Another surface for engaging a second magazine within second slot 29 is formed by the second inner surface 145 of the center extension 125 and the inner surface 150 of the left extension 130.

The combined inner surfaces 90, 95, 100, 105, 135, 140, 145, 150 of the upper plate 5 and the lower plate 10 thus define slots 27 and 29, and provide surfaces for engaging two firearm magazines. The configuration or shape of the aforementioned inner surfaces may be adapted to substantially conform to the sides or casing of various magazines to be held. For example, the drawings illustrate a device for use with an M16 automatic rifle, and particularly thirty round United States military 5.56 mm M16A2 Service Rifles or NATO issue M16s. Other firearms with magazines compatible with the present invention include but in no way are limited to: Bushmaster M17S, XMI5E2S, AR-180B, CAV-15's, M96 Rifle, M16 Series, AR-15's, M14s, AK47, Fabrique National Series, AR10, M14, and the U.S. military's M249 Squad automatic Weapon (SAW). The device of the present invention is useful with metal, plastic, or nylon magazines. Inner surfaces of an upper plate and lower plate that substantially conform to the side or casing of the magazine(s) will facilitate greater surface area contact for securing the magazine(s) than inner surfaces that are not as precisely shaped. The combined inner surfaces of the upper plate 5 and lower plate 10 may be serrated, ribbed, or roughened in order to provide an additional means for gripping the magazine(s).

The terms first magazine 190 and second magazine 195 are used for descriptive purposes only and are in no way meant to limit the order or location of magazine placement in accordance with the present invention. A thickness of not greater than approximately 0.12 inches of the distal portion of the right extensions 45, 120 and the left extensions 55, 130, as shown by distance "t" in FIGS. 2*a*–2*b*, provide excellent combined performance features of weight, strength, and durability. The upper plate 5 and lower plate 10 may be constructed from a wide variety of materials. For example, the upper plate 5 and lower plate 10 may be constructed of titanium alloy, fiberglass, plastic, or aluminum. A preferred material is tempered T6 aluminum square/rectangular bar, one weight percent black anodized. The black color helps make the device non-reflective.

Lower plate 10 includes an aperture 160 for receiving the securing member foot 30. Typically, the aperture 160 is threaded to receive a threaded foot 30. The aperture 160 may extend partially through lower plate 10, as shown in FIG. 2*b*, or entirely through, as shown in FIG. 2*a*, and may contain a helicoil (not shown) therein.

In one embodiment, as in FIGS. 2*a*–2*b*, the upper plate 5 and the lower plate 10 are substantially the same size and shape, and are positioned symmetrically to one another relative the securing member body 25. Upper and lower plates 5 and 10 are preferably mirror images of each other, excluding the recess 60 of upper plate 5 and the aperture 160 of the lower plate. The plates 5, 10 are thus substantially symmetric to each other relative the central longitudinal axis 80 of securing member 15 when in use. This is best seen in FIGS. 2*a*–2*b*, and FIG. 7. Using substantially the same size and shape for the upper plate 5 and lower plate 10 facilitates application of a uniform pressure on the side or casing of the firearm magazine(s) when tightening the securing member 15. Additionally, the application of a uniform pressure while tightening the securing member 15 enhances the ability of the present invention to securely hold multiple magazines when compared to the prior art shown in FIG. 1.

For example, in order to apply even pressure on a plurality of magazines, the prior art device would require an individual to alternate back and forth between tightening two different bolts "B". Back and forth tightening of the bolts is not only time consuming but quite imprecise as a method of achieving uniform pressure to the firearm magazines. Typically, the surface of the middle magazine will have a greater pressure applied than the surfaces of the outer magazines. Additionally, as the plurality of magazines are emptied of their ammunition, the hollow magazine casings will tend to deform slightly from the applied pressure. The deformed magazine side or casing will further reduce the pressure on the surface of the outer magazines resulting in unsecured magazines. On the other hand, precise and evenly applied pressure, through the use of a single centrally located securing member 15 as described herein, will remain substantially consistent even when the magazines are empty.

Figure 3C:
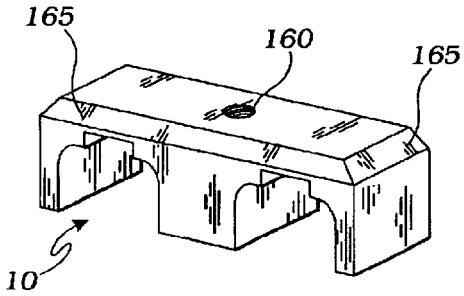
FIG. 3*c* is a perspective view of the bottom of a bottom plate of a firearm magazine grip in accordance with the present invention.

Turning now to FIGS. 3*a*–3*b*, perspective views of the top of an upper plate 5 are shown. FIG. 3*a* shows one embodiment of upper plate 5 with curved outer edge surfaces 165 at the transition from outer surface 35 to front surface 22 and back surface (not shown), and FIG. 3*b* shows another embodiment of upper plate 5 with chamfered outer edge surfaces 165. FIG. 3*c* shows a perspective view of the bottom of a bottom plate 10. The plates 5 and 10 have chamfered or substantially curved outer edge surfaces 165. Typically, the degree of curvature of the substantially curved outer edge surfaces 165 is greater than the degree of curvature at edges between front surfaces 22 and 24 and inner surfaces 40 and 115 respectively, which may be only subtly curved to eliminate sharpness. The curved surfaces are also known as "bull-nosed" or "radialed" surfaces, to distinguish them from sharp edges common in the prior art devices. A preferred degree of curvature of the outer edge surfaces 165 of plates 5 and 10 is 0.18 inches.

Figure 1:
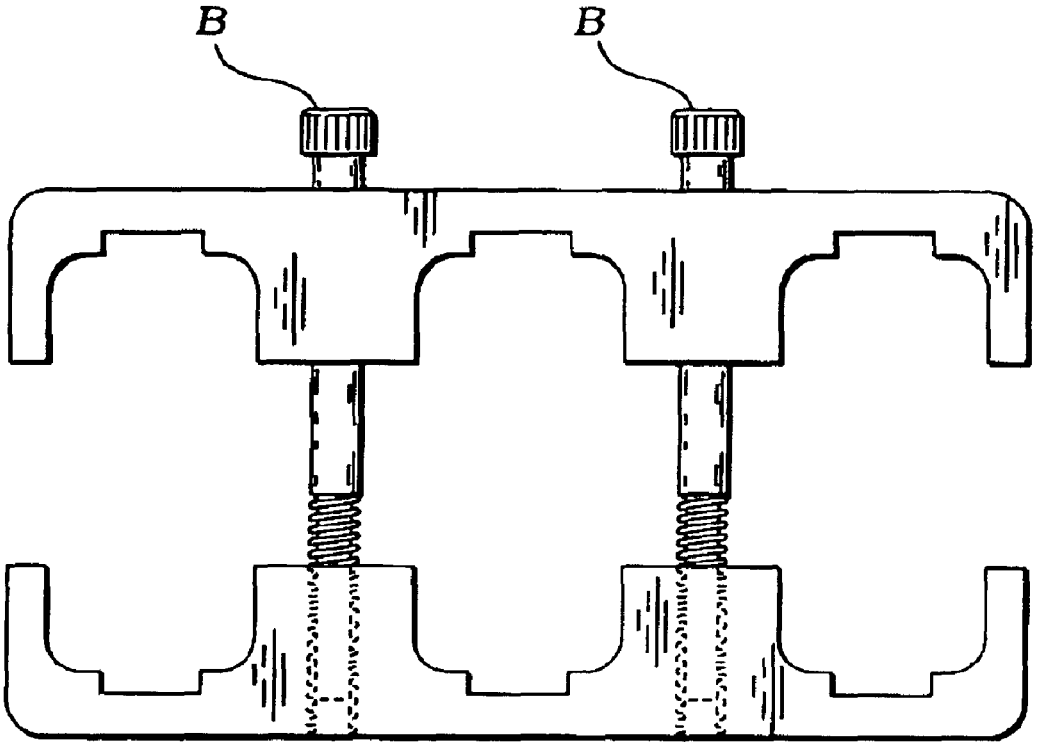
Prior Art Fig. 1
FIG. 1 shows a prior art magazine holder.

The substantially curved edge surfaces, including outer edge surfaces 165, along with upper plate recess 60, eliminates sharp edges and permits the top surface 92 of the securing member head 20 to be substantially flush with the outer surface 35 of the upper plate 5 while in use, thus reducing the potential for injury due to sharp and/or protruding surfaces, edges and/or objects when compared to prior art devices. As shown in FIG. 1, for example, the prior art device utilizes bolts that protrude above the outer surface of the upper plate. The protruding bolts increase the potential that an individual may be cut, bruised, scraped, or otherwise injured. In addition, clothing may become snagged or caught on the protruding bolts causing an unwanted mishap or accident In contrast, the recessed top surface 92 of the securing member head 20, and substantially curved and/or chamfered outer surface edges 65 of the plates 5, 10 of the present invention, offer a profile void of any obtrusive structures.

Another potential problem area of the prior art is the sharp merging edge surfaces. The merging surfaces of the prior art form well-defined edges that may cause damage to a person's skin. Sharp edge surfaces are utilized throughout the prior art devices. In contrast, the substantially curved edge surfaces of the device of the present invention offer a smooth transition from one surface to another. The substantially curved edge surfaces of the present invention, including outer edge surfaces 165, thus reduce the potential for cuts, punctures or other damage to the skin. Similarly, the heads of the bolts "B" in the prior art devices, as seen in FIG. 1, protrude due to the lack of a recess in the upper plate of the prior art device for receiving them, and such protruding metal may also be a potential source of cuts, bruises, etc.

Figure 4:
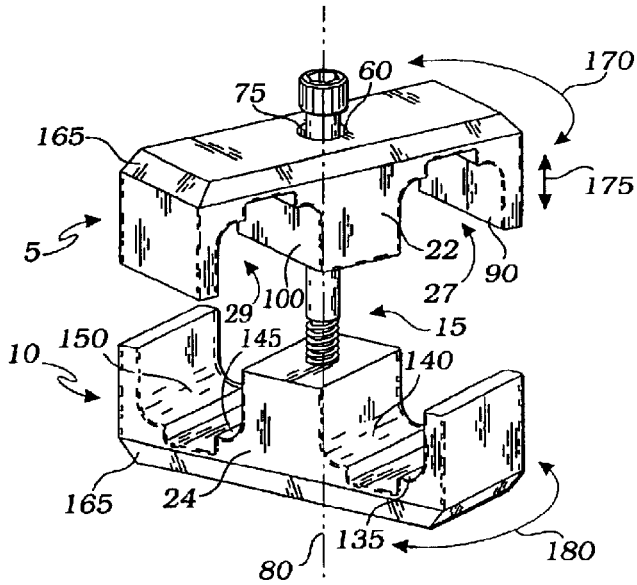
FIG. 4 is a perspective view of a preferred embodiment of a firearm magazine grip in accordance with the present invention.

Turning now to FIG. 4, a perspective view of a preferred embodiment of the firearm magazine grip in accordance with the present invention is shown. The upper plate 5 and the lower plate 10 are capable of multidirectional movements 170, 175, 180. Multidirectional movements 170, 175, 180 of the upper plate 5 and lower plate 10 are made possible due to the physical relationship and placement of the plates 5, 10 with respect to each other and with respect to the securing member 15. The upper plate 5 is rotationally positioned about the securing member 15 as best seen in FIG. 4. The upper plate aperture 75 encircles the securing member 15, but it is not physically connected thereto, thus allowing free/unrestricted 360 degree rotation about the central longitudinal axis 80 of the securing member in both directions, as seen by directional arrow 170.

Upper plate 5 is also free to move vertically relative the central longitudinal axis 80 of the securing member 15, as indicated by directional arrow 175. Such linear movement is referred to herein as translation, to distinguish from rotational movement as indicated by arrow 170. The upward limit of vertical translation of the upper plate 5 is defined by the dimensions of the head 20 of the securing member 15 in relation to the depth of recess 60 and inner lip 70. That is, as upper plate 5 is translated upward, head 20 is received into recess 60 and the bottom surface of head 20 engages inner lip 70 preventing further vertical translation of upper plate 5. A split washer (not shown) may also be placed on inner lip 70 such that the head 20 engages the washer instead. It is intended that in such a configuration the bottom surface of head 20 is still considered to be engaging the inner lip 70, even though there may not be direct physical contact between the two. This same relationship may be viewed from the perspective of the securing member 15, as preventing securing member 15 from passing entirely through countersink 60.

The downward limit of vertical translation of the upper plate 5 is defined by the relationship of the upper plate 5 to the lower plate 10. Specifically, the lower plate 10 is secured by being mounted to the foot 30 of the securing member 15. As such, when inner surfaces 32 of upper plate 5 engage inner surfaces 33 of lower plate 10, upper plate 5 is prevented from further downward translational movement. Also, when the device is in use, the body of the magazines 190, 195 will prevent such translational movement once the magazines 190, 195 are secured, as seen in FIG. 7.

In one embodiment, in which aperture 160 extends entirely through lower plate 10 (see FIG. 2*a*), the boundaries of rotational movement of the lower plate 10, as shown by directional arrow 180, are defined by the thread length of the securing member foot 30. In another embodiment, in which aperture 160 does not extend all the way through lower plate 10 (see FIG. 2*b*), such rotational movement may additionally or alternatively be limited by the depth of aperture 160. In either case, rotational movement of lower plate 10 is typically free within a range of at least 5 degrees in either direction.

It will be apparent to those skilled in the art that the rotational movement described with respect to the lower plate 10 refers not only to rotation about the central longitudinal axis 80 of securing member 15, but also to vertical translation thereof due to the threaded properties of securing member foot 15 and aperture 160. In this respect, such rotational movement of the lower plate 10 varies from rotational movement of upper plate 5, because since upper plate 5 is not mounted it is capable of rotation without vertical translation. The rotation and vertical translation of the plates 5, 10 is thus restricted only as described herein, and the multidirectional movements 170, 175, 180 of the upper plate 5 and the lower plate 10 facilitate placement and securing of the magazines between the upper plate 5 and lower plate 10.

Turning now to FIG. 7, a perspective view of the firearm magazine grip of the present invention is shown holding two magazines 190, 195. The magazines 190, 195 are placed between the upper plate 5 and lower plate 10 in slot 27, 29, engaging the inner surfaces 40 and 115. Securing member 15 (not shown) is tightened to secure the magazines 190, 195 in place. When compared to the prior art device shown in FIG. 1, the multidirectional movements 170, 175, 180 of the upper plate 5 and the lower plate 10 greatly enhance placement and securing of the magazine(s) between the upper plate 5 and lower plate 10. The prior art device requires the magazines to be inserted along well-defined channels in order to be placed properly within the upper and lower plates. At best, the prior art provides only minute movement of the upper plate and essentially no movement of the lower plate, making placement of a magazine cumbersome. Any rotational movement of the plates in the prior art device is insignificant and not measurable, and is at most on the order of less than 1 or 2 degrees. Also, an individual must alternate back and forth between adjusting the two protruding bolts of the prior art device in order to tighten the device. The technique of adjusting two bolts is time consuming. Additionally, unless the two bolts are adjusted equally, the upper and lower plates will not form an even, proper, channel for placement of the magazines.

In contrast, multidirectional movement of the plates 5, 10 of the present invention as described herein provides the upper plate 5 and lower plate 10 with a greater degree of rotational and translational movement for quick and easy placement of the magazines. Properly placing and securing of the magazines will result in the securing member head 20 being substantially within recess 60 and/or substantially flush with the outer surface 35 of the upper plate 5. In either case, the head 20 will not protrude beyond the outer surface 35 of upper plate 5. A separate embodiment includes a mushroom or domed head of the securing member 15, such that even if it protrudes slightly, it does not contain any sharp edges. Magazines may be placed between the upper plate 5 and lower plate 10 in a parallel configuration, as shown in FIG. 7. Alternatively or additionally, the magazines may be inverted in relation to each other, or placed in a vertically staggered configuration. In one embodiment (not shown) the device may be configured to receive two magazines such that they are positioned at 45 degree angles to each other relative the plane of front surfaces 22, 24, or to receive a plurality of magazines in other formations such as a circular or partially circular formation. A single magazine or a plurality of magazines may be used in accordance with the present invention.

Figure 5:
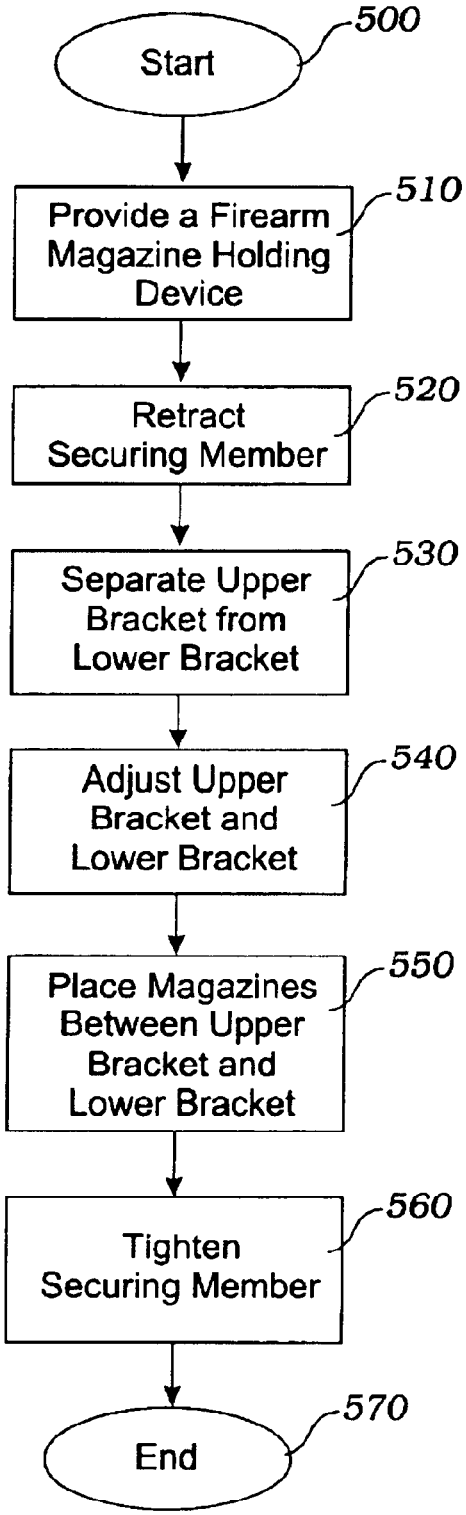
FIG. 5 is a flow chart illustrating a method of securing a plurality of firearm magazines in a device in accordance with the present invention.

Turning now to FIG. 5, a flow chart illustrating a method of holding a plurality of firearm magazines in accordance with the present invention is shown. The process begins at 500. At step 510, a firearm magazine holding device as described herein is provided. A manufacturer, distributor, or other third party may supply the device. In this respect, "providing" the device is intended to refer to the fact that such a device is in fact present in use with the method, and so the device may be provided by the actual user thereof The securing member is then retracted from the lower plate, as seen in step 520. Typically, retraction of the securing member is accomplished by unscrewing the threaded foot of the securing member from the threaded aperture of the lower plate. This step is optional, as it is intended to refer to the rotational movement of the lower plate clockwise such that as the lower plate translates lower, in effect the securing member translates upward or is retracted from the lower plate. This is optional because it is very likely that the lower plate will be rotated only counterclockwise, or not at all, since tightening the device does not require retraction of the securing member. In other words, the lower plate may remain stationary, while the securing member is tightened thus causing the securing member to be inserted into the lower plate and not retracted therefrom.

At step 530, the upper plate and lower plate are separated in order to provide sufficient space between the upper plate and lower plate for placement of the magazine(s). At step 540, the upper plate and lower plate are adjusted to accommodate placement of the magazine(s) between the upper plate and the lower plate. Adjustment of the upper plate may include rotational and translational movement as described herein. Adjustment of the lower plate may include rotational movement as described herein. At step 550, the magazine(s) are placed between the upper plate and the lower plate. At step 560, the securing member is tightened. Tightening of the securing member brings the applicable inner surfaces of the upper plate and the lower plate into contact with the side or casing of the magazine(s), and places the top surface of the securing member head in a position substantially within the recess and/or flush with the upper surface of the upper plate.

Typically, the shape of the inner surfaces of the upper plate and the lower plate will substantially conform to the side or casing of the magazine(s) to be held. Inner surfaces of an upper plate and lower plate that substantially conform to the side or casing of the magazine(s) will facilitate greater surface area contact for securing the magazine(s). The process ends at step 570, at which time the first magazine may be inserted into the firearm well. Once the first magazine is emptied, the device (with the magazines secured therein) may be disengaged from the firearm, and the unspent magazine may then be inserted into the firearm well.

The multidirectional movement of the upper plate 5 and lower plate 10, substantially curved edge surfaces (including outer edge surfaces 165) and/or chamfered outer edge surfaces 165, recessed securing member head 20, and other structural elements as described herein, thus provide for a device capable of holding a plurality of firearm magazines that is more efficient, safer, highly effective, and more reliable than known devices.

While certain embodiments are illustrated in the drawings and are described herein, including preferred embodiments, it will be apparent to those skilled in the art that the specific embodiments described herein may be modified without departing from the inventive concepts described. For example, the plates may be machined, stamped, or manufactured using various well-known methods. Additionally, the device may be used with firearm replicas, dummy training firearms (demonstration, classes, display), F.A.T.S. machine weaponries, movie props, and live simmunition weapons (commonly used by both military and law enforcement personnel. Also, the outer edge surfaces of upper and/or lower plate may be chamfered and/or curved, independent of each other.

What is claimed is:

1. A device for holding a plurality of magazines for use with a firearm comprising:

a securing member having a head, a body, and a foot, said head further having a top surface and a bottom surface;

an upper plate having an outer surface and an inner surface, wherein the upper plate further has a recess for receiving the securing member head, said recess having an inner lip for engaging the bottom surface of the securing member head such that the top surface of the securing member head is contained substantially within the recess, said upper plate further having an aperture for permitting the securing member foot and the securing member body to pass therethrough, wherein the upper plate is rotationally positioned about the body of the securing member; and;

a lower plate having an inner surface and an outer surface, wherein the lower plate further has an aperture for receiving the securing member foot, said tower plate being rotationally mounted to the foot of the securing member;

wherein the inner surfaces of the upper plate and lower plate together define first and second slots configured to engage first and second firearm magazines respectively, said first slot having a top surface, a bottom surface and a pair of side surfaces.

2. The device of claim 1, wherein the inner lip of the recess extends radially inward to define the aperture in the upper plate, and wherein the securing member head is substantially flush with the outer surface of the upper plate.

3. The device of claim 1, wherein the upper plate and the lower plate are substantially the same size and shape, and are positioned symmetrically to one another relative the securing member body.

4. The device of claim 3, wherein the upper and lower plates each have a right extension and a left extension with a maximum distal thickness of approximately 0.12 inches each.

5. The device of claim 3, wherein the upper plate and the lower plate each have substantially curved outer edge surfaces.

6. The device of claim 3, wherein the inner surfaces of the plates are adapted to substantially conform to M16 automatic rifle magazines.

7. The device of claim 3, wherein the inner surfaces of the plates have gripping means for gripping the first magazine and the second magazine.

8. The device of claim 3, wherein the upper plate and the lower plate each have chamfered outer edge surfaces.

9. The device of claim 1, wherein the securing member head comprises tightening means for securing a first magazine and a second magazine between the upper plate and the lower plate.

10. The device of claim 9, wherein the tightening means is a hex head recess.

11. The device of claim 10, wherein the foot of the securing member is threaded, and the aperture of the lower plate is correspondingly threaded to receive the foot of the securing member.

12. The device of claim 1, wherein said second slot has a top surface, a bottom surface and a pair of side surface.

13. A method of holding a plurality of firearm magazines comprising the steps:

providing a firearm magazine holding device comprising: a securing member having a head, a body, and a threaded foot, said head having a top surface and a bottom surface; an upper plate having an outer surface with a recess therein for receiving the securing member head, wherein the recess further has an inner lip for engaging the bottom surface of the securing member head, said upper plate further having an aperture for permitting the securing member foot and the securing member body to pass therethrough, wherein the upper plate is rotationally positioned about the body of the securing member; and a lower plate having a threaded aperture for receiving the securing member foot, wherein the lower plate is rotationally mounted to the securing member foot, said upper plate and lower plate defining a plurality of slots for engaging a plurality of firearm magazines, at least one of said slots having a top surface, a bottom surface and a pair of side surfaces, separating the upper plate from the lower plate a sufficient distance to allow a plurality of firearm magazines to be positioned therebetween;

adjusting the upper plate and the lower plate to facilitate placement of the plurality of magazines therebetween, including rotating the lower plate at least five degrees about the central longitudinal axis of the securing member, rotating the upper plate at least five degrees about the central axis of the securing member, and vertically translating the upper plate about the central longitudinal axis of the securing member;

placing a plurality of magazines between the upper plate and the lower plate; and tightening the securing member to secure the plurality of magazines between the upper plate and the lower plate, and to position the securing member head to be substantially contained within the recess of the upper plate.

14. The method of claim 13, wherein the upper plate has substantially curved outer edge surfaces.

15. The method of claim 13, wherein the top surface of the securing member head is positioned to be substantially flush with the outer surface of the upper plate.

16. The method of claim 13, wherein the upper plate and the lower plate are shaped to substantially conform with sides of the plurality of magazines.

17. The method of claim 13, wherein the upper plate has chamfered outer edge surfaces.

18. The device of claim 13, wherein all of said slots have a top surface, a bottom surface and a pair of side surfaces.

19. A device for holding two firearm magazines comprising:

an upper plate having an outer surface and an inner surface; and a securing member having a head, a body, and a foot, said head having a top surface and a bottom surface;

wherein the upper plate is rotationally positioned about the body of the securing member;

wherein the lower plate is rotationally mounted to the foot of the securing member;

wherein the upper plate has a recess with an aperture, and the securing member foot and the securing member body pass through the recess and the aperture of the upper plate, the securing member head being received in the recess such that the bottom surface of the securing member head engages an inner lip of the recess thus preventing the securing member head from passing through the aperture of the upper plate, the depth of the recess and the height of the securing member head being such that the top surface of the securing member head is contained substantially within the recess;

wherein the lower plate receives the securing member foot in a threaded aperture;

wherein the inner surface of the upper plate defines first and second slots adapted to engage top surfaces of first and second firearm magazines respectively, said first and second slots each having a top surface and a pair of side surfaces, and the inner surface of the lower plate defines corresponding first and second slots adapted to engage bottom surfaces of the first and the second firearm magazines respectively, said corresponding first and second slots each having a bottom surface and a pair of side surfaces, such that together the upper plate and the lower plate securely receive the first and second firearm magazines in the first and second slots respectively, upon tightening of the device; and wherein the device is configured to hold two firearm magazines.

20. The device of claim 19, wherein the top surface of the securing member head is substantially flush with the outer surface of the upper plate.

21. The device of claim 19, wherein the firearm magazines are M16 automatic rifle magazines.

22. The device of claim 19, wherein the threaded aperture of the lower plate extends entirely therethrough.

23. The device of claim 19, wherein the upper plate has chamfered outer edge surfaces.

* * * * *

UNITED STATES PATENT AND TRADEMARK OFFICE

CERTIFICATE OF CORRECTION

PATENT NO. : 6,796,074 B1
DATED : September 28, 2004
INVENTOR(S) : Obong

It is certified that error appears in the above-identified patent and that said Letters Patent is hereby corrected as shown below:

Column 10,
Line 39, please change "said tower plate" to -- said lower plate --

Column 11,
Line 14, please change "pair of side surface." to -- pair of side surfaces. --

Signed and Sealed this

Tenth Day of May, 2005

JON W. DUDAS
*Director of the United States Patent and Trademark Office*